US006550936B2

(12) United States Patent
Foley

(10) Patent No.: US 6,550,936 B2
(45) Date of Patent: Apr. 22, 2003

(54) PRISM LANTERN

(76) Inventor: James F. Foley, 17747 Revello Dr., Pacific Palisades, CA (US) 90272

( * ) Notice: Subject to any disclaimer, the term of this patent is extended or adjusted under 35 U.S.C. 154(b) by 0 days.

(21) Appl. No.: 09/776,499

(22) Filed: Feb. 5, 2001

(65) Prior Publication Data

US 2002/0105806 A1 Aug. 8, 2002

(51) Int. Cl.[7] ..... F21V 5/02

(52) U.S. Cl. ..... 362/268; 362/154; 362/161; 362/317; 362/335; 362/339; 362/166; 362/171; 362/337

(58) Field of Search ..... 362/268, 154, 362/161, 317, 335, 339, 166, 171, 337

(56) References Cited

U.S. PATENT DOCUMENTS 65,229 A * 5/1867 Irwin
6,336,735 B1 * 1/2002 Eddins ..... 362/351

OTHER PUBLICATIONS

U.S. patent application Publication US 2001–0040800 A1, Nov. 15, 2001, Carpenter et al.*

* cited by examiner

*Primary Examiner*—Sandra O'Shea
*Assistant Examiner*—Sharon Payne
(74) *Attorney, Agent, or Firm*—Sanford Astor

(57) ABSTRACT

Prism Lantern with a pair of concentric glass cylinders, the first the cylinder being approximately three and one half inches in diameter and eight and one half inches tall, the second the cylinder being approximately three and three eighths inches in diameter and eight and one half inches tall, the cylinders fastened at their bottom surfaces to a base plate so that there is a concentric air space between the first cylinder and the second cylinder, a sheet of plastic material having a plurality of molded in prisms is placed in between the outer wall of said first cylinder and the inner wall of said second cylinder, and a closure ring enclosing the top of said concentric cylinders. Said plastic prism material creates a unique multi colored star burst pattern when viewed by an onlooker.

6 Claims, 2 Drawing Sheets

PRISM LANTERN

BACKGROUND OF THE INVENTION

This invention relates generally to the field of Candle holding lanterns, and more particularly to a prism Lantern.

Lanterns of many types have been designed and sold in the past. Many lanterns involve the use of an enclosure that houses a candle or candles wherein the lantern housing protects the candle from being blown out in a breeze. Other lanterns employ reflectors to further enhance the lighting effect of the candle.

Many lanterns are designed to provide a pleasing decorative effect as well as to provide protection for the candle light.

Although many lanterns exist today, there has been no lantern available that emits a pulsating, multi colored star burst prism like effect.

SUMMARY OF THE INVENTION

The primary object of the invention is to provide a candle holding lantern that emits a pulsating, multi colored rainbow prism lighting effect when the candle flame is viewed by an onlooker.

Another object of the invention is to provide a candle holding lantern that protects said prism emitting sheet from the heat of said candle flame.

Other objects and advantages of the present invention will become apparent from the following descriptions, taken in connection with the accompanying drawings, wherein, by way of illustration and example, an embodiment of the present invention is disclosed.

Prism Lantern comprising: a pair of concentric glass cylinders, the first said cylinder being approximately three and one half inches in diameter and eight and one half inches tall, the second said cylinder being approximately three and three eighths inches in diameter and eight and one half inches tall, said cylinders fastened at their bottom surfaces to a base plate so that there is a concentric air space between said first cylinder and said second cylinder, a sheet of plastic prism material placed in between the outer wall of said first cylinder and the inner wall of said second cylinder, and a closure ring enclosing the top of said concentric cylinders.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
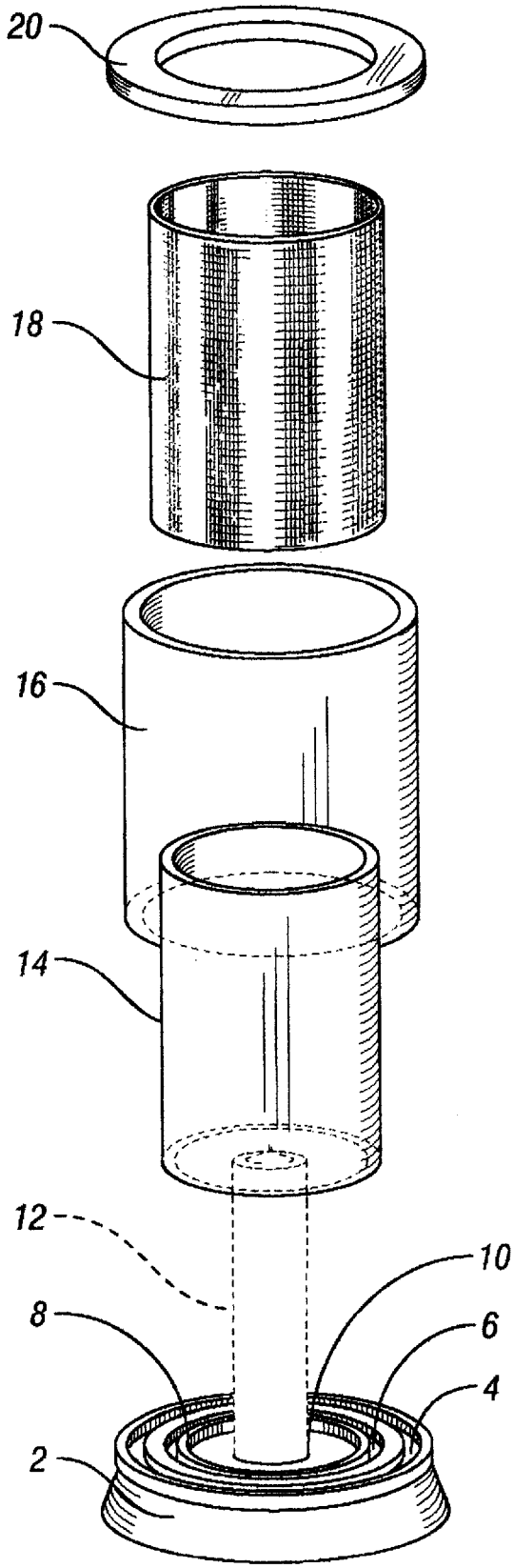
FIG. 1 is an exploded view of the lantern of the present invention.
Figure 2:
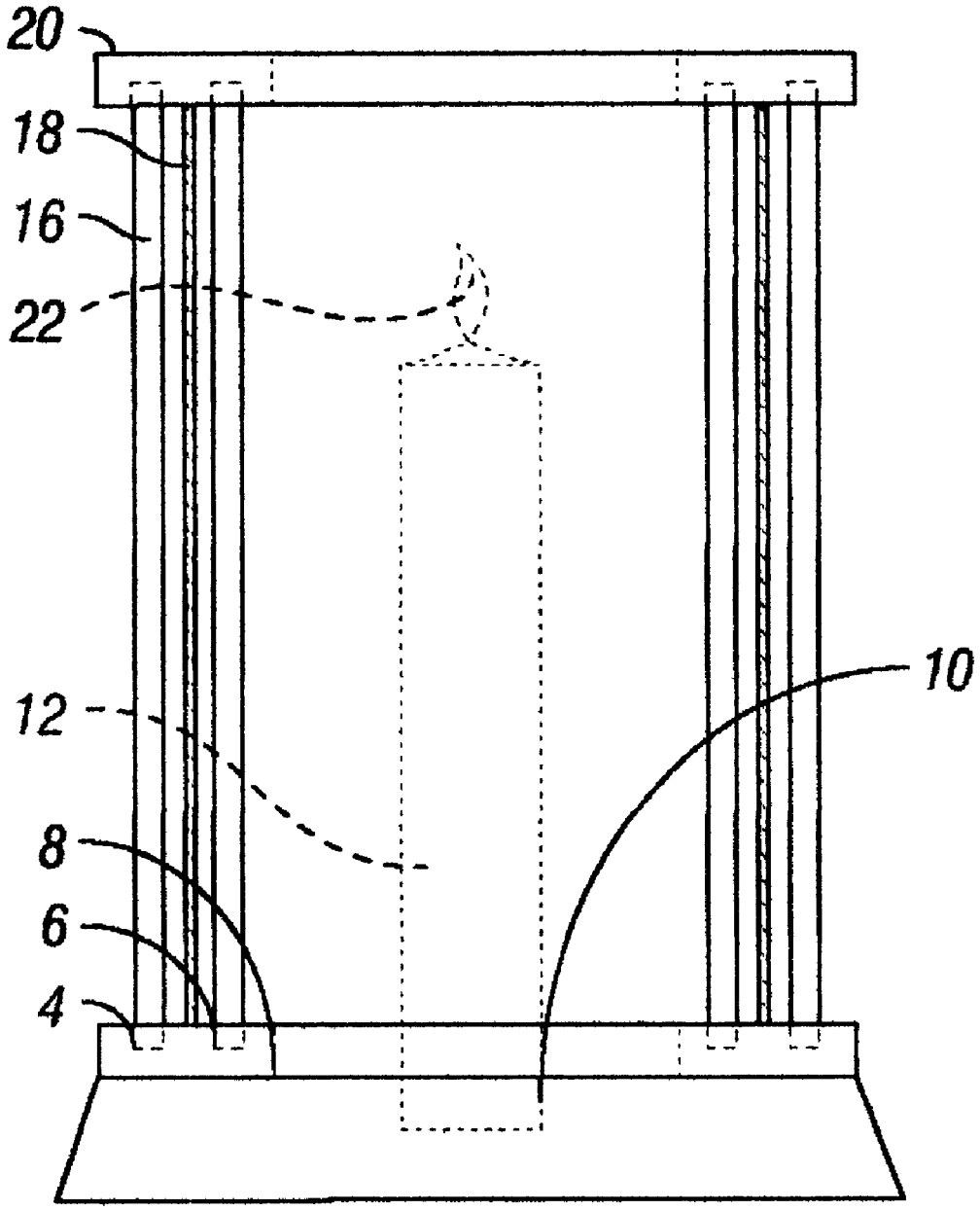
FIG. 2 is a side section view of the lantern of the present invention.

Referring now to FIG. 1 we see an exploded view of the prism lantern of the present invention. Base plate 2 contains two concentric depressions 4, 6 that can accommodate clear inner glass cylinder 14 and clear outer glass cylinder 16. Candle holding portion 19 is fixedly attached to the center of base plate 2 at its central depressed candle holding portion 10. Larger diameter candles can simply sit on base plate 8. A sheet of clear plastic, prism making material 18, is formed into a cylinder and dropped into the space between outer glass 16 and inner glass 14. The prism sheet material, called Spectrasheen, is made by Spectratek of Los Angeles, Calif. They describe it as a "holographic" material. Another manufacturer of a similar sheet of prism making material is available from the Edmund Scientific Company of Barrington N.J. and is called a Jupeterscope special effects lens. The description of this material talks of having over one hundred and fifty thousand tiny lenses molded into the clear sheet. A closure ring 20 the top surfaces of outer glass 16 and inner glass 14. Candle 12 is placed into candle holder 10. When candle 12 is lit and the sheet of plastic prism material is in place the resulting effect is a multi color star burst, rainbow pattern that emanates from all points of the outer cylinder 16. The pulsating, flickering effect of the candle light also causes the colored star burst pattern to pulsate. FIG. 2 is a side section view of the lantern of the present invention that is shown for further clarity. Because the plastic prism material 18 is entrapped within the two glass cylinders, it is safe from burning or other deterioration that might otherwise occur. Obviously, an alternate embodiment can be envisioned where there is only one glass cylinder and the plastic sheet of prism material is wrapped around the glass. In this embodiment however, the prism material is exposed and could result in scratching or other deterioration of the plastic sheet.

In the above described and illustrated way the unique lantern of the present invention produces a beautiful, safe pulsating star burst effect that can be seen on all sides of the lantern.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A prism lantern comprising:

a pair of concentric glass cylinders;

the first cylinder being slightly larger in diameter than the second cylinder, creating a small space between the first cylinder and the second cylinder;

said cylinders sitting in two concentric depressions in a base plate;

a sheet of prismatic material in the small space between said first cylinder and said second cylinder; and a closure ring enclosing the top of said concentric cylinders.

2. The lantern of claim 1 further comprising a candle at the center of said base plate.

3. The lantern of claim 1 in which the prismatic material is a plastic sheet having a plurality of prism lenses molded therein.

4. The device of claim 1 in which the closure ring is fixedly attached, to protect the prismatic material from deterioration.

5. A prism lantern comprising:

a pair of concentric glass cylinders;

the first cylinder being slightly larger in diameter than the second cylinder, creating a small concentric space between the first cylinder and the second cylinder;

both of said cylinders sitting in two concentric depressions in a base plate;

a plastic sheet of prismatic material, having a plurality of prism lenses molded in said plastic sheet, in the small concentric space between the outer wall of said first cylinder and the inner wall of said second cylinder;

a closure ring having two grooves fixedly enclosing the top of said concentric cylinders.

6. The lantern of claim 5 further comprising a candle at the center of said base plate.

* * * * *